United States Patent [19]

Ventura

[11] Patent Number: 4,678,451

[45] Date of Patent: Jul. 7, 1987

[54] INTERFITTING TOY VEHICLE BODY AND CHASSIS

[75] Inventor: Frank D. Ventura, Newburyport, Mass.

[73] Assignee: Kenner Parker Toys Inc., Beverly, Mass.

[21] Appl. No.: 789,817

[22] Filed: Oct. 21, 1985

[51] Int. Cl.[4] ..... A63H 17/26

[52] U.S. Cl. ..... 446/471

[58] Field of Search ..... 446/4, 85, 86, 88, 93, 446/94, 95, 96, 225, 226, 385, 470, 471, 431, 465, 486, 490

[56] References Cited

U.S. PATENT DOCUMENTS

| | | | |
|---|---|---|---|
| 2,839,788 | 6/1958 | Dembiak | 446/385 X |
| 3,599,366 | 8/1971 | Pauly | 446/469 |
| 3,611,630 | 5/1970 | Adickes et al. | 446/469 |
| 3,699,715 | 10/1972 | Lewis et al. | 446/385 X |
| 3,721,042 | 3/1973 | Marason, Jr. | 446/471 |
| 3,816,957 | 6/1974 | Nakajima | 446/385 X |
| 3,835,583 | 9/1974 | Manning | 446/465 |
| 4,413,443 | 11/1983 | Kulesza et al. | 446/471 X |
| 4,451,109 | 11/1985 | Hanson | 446/465 X |
| 4,470,219 | 10/1984 | Sugimoto | 446/471 X |
| 4,594,072 | 1/1986 | Cowell | 446/486 X |

*Primary Examiner*—Robert A. Hafer
*Assistant Examiner*—D. Neal Muir
*Attorney, Agent, or Firm*—L. MeRoy Lillehaugen; Gene O. Enockson

[57] ABSTRACT

The toy vehicle is comprised of a chassis composed of a relatively hard plastic and a body composed of a relatively soft, elastomeric plastic. The chassis includes a box-like frame having upstanding walls, each of said walls having an outwardly issuing flange adjacent the upper edge thereof. The body is formed with walls forming a downwardly facing recess, each wall having adjacent its upper edge an outwardly directed groove for receiving therein the various flanges on the upstanding walls of the box-like frame. Owing to the elasticity of the body, the walls forming the downwardly facing recess can be flexed or stretched so as to permit the flanges on the upstanding walls to be introduced into the grooves and retained therein when the elastomeric material constituting the body is allowed to contract or return to its non deformed condition. In this way, the chassis and body are firmly held together and constitute for all intents and purposes a unitary structure with which the child can play.

6 Claims, 4 Drawing Figures

INTERFITTING TOY VEHICLE BODY AND CHASSIS

FIELD OF THE INVENTION

This invention relates generally to toy vehicles, and pertains more particularly to a two-part vehicle comprised of a body interfitted with an underlying wheeled chassis.

SUMMARY OF THE INVENTION

The manufacture of toy vehicles has posed a number of fabrication problems. For instance, dies become quite complicated when the toy vehicle is molded as a unitary structure. Another problem arises where the body of the vehicle is to be made from a soft, elastomeric material and the chassis from a hard and more rigid material. If the vehicle is comprised entirely of an elastomeric material, then for all intents and purposes wheels cannot be properly employed so as to render the vehicle mobile as is intended; the soft material militates against the use of axles capable of having wheels mounted thereon. On the other hand, where the body is of soft plastic and the chassis of relative hard plastic, the means for attaching the chassis to the body becomes a problem; it should be as simple as possible. Otherwise, the labor required in assembling the vehicle can be quite substantial. Also, the molds should not be too complicated, for this can increase the cost of manufacturing the toy, resulting in the vehicle having to be sold at a noncompetive price. As with most toys, the manufacture of toy vehicles demands that the vehicle be manufactured inexpensively and yet possess certain characteristics that make the vehicle appealing to children of various ages.

Accordingly, a general object of the present invention is to provide a toy vehicle that can be manufactured inexpensively so that it can be marketed at a relatively low price.

Another object of the invention is to provide a toy vehicle that will be appealing to children of various ages.

Still another object is to provide a two-piece vehicle that is comprised of a body and wheeled chassis that can be readily assembled but difficult to disassemble. In other words, an aim of the invention is to provide a toy vehicle that once assembled will remain assembled, although a sufficient amount of detaching effort can effect a separation of the two parts from each other should circumstances so dictate.

Yet further, a specific object of the invention is to provide a toy vehicle of the foregoing character that can be molded in two parts, namely, a soft, elastomeric body and an underlying relatively rigid chassis on which wheels can be rotatably mounted. It will be appreciated that wheels cannot be effectively mounted on a soft, elastomeric material.

Briefly, the present invention envisages the molding of an elastomeric material, such as polyvinyl chloride, in the form of a suitably shaped body and separately molding the chassis utilizing a relatively hard plastic, such as copolymer polypropylene, onto which can be rotatably mounted suitable plastic wheels, preferably of the same material as that constituting the chassis. The body and chassis are formed during the molding process so that they can be readily interfitted together, requiring only a minimum amount of assembly effort. More specifically, it is planned that the body be molded with a downwardly facing recess having grooves in the walls thereof, which grooves receive outwardly directed flanges integral with the box-like frame of the chassis. Axles are also molded integral with the chassis so that appropriate wheels can be easily attached so as to render the composite vehicle mobile.

DESCRIPTION OF PREFERRED EMBODIMENTS

Figure 1:
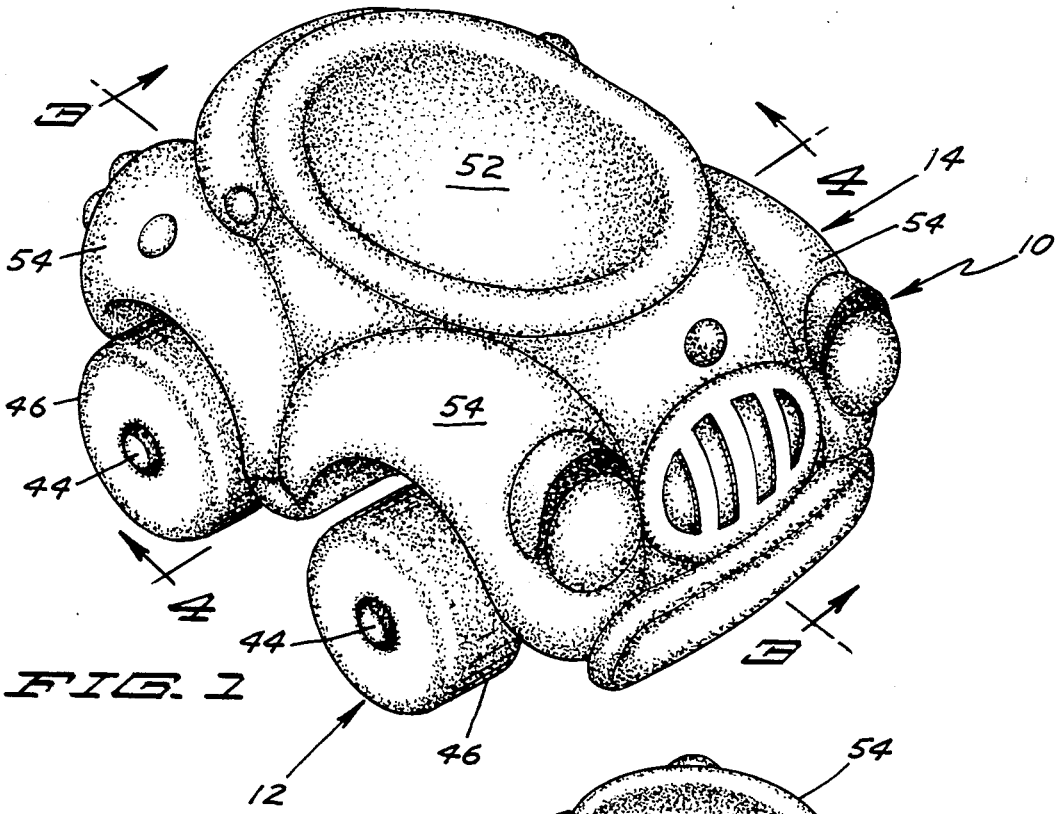
FIG. 1 is a perspective view of a toy vehicle exemplifying our invention.
Figure 2:
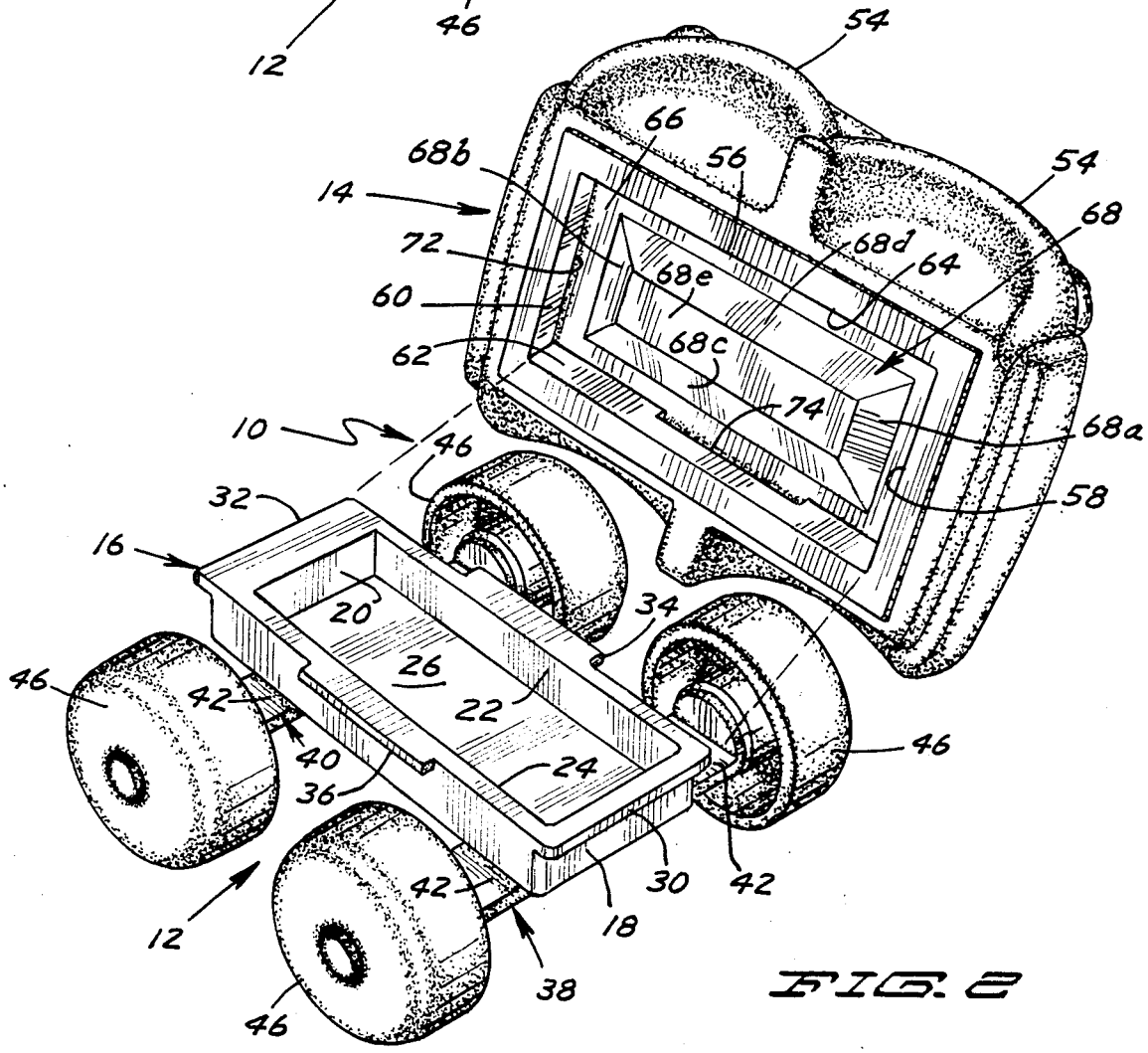
FIG. 2 is a perspective view taken in the same direction as FIG. 1 but depicting the body of the vehicle in an open book relation with the chassis.

Referring now in detail to the drawings, a vehicle illustrating our invention has been denoted generally by the reference numeral 10. The vehicle 10, as shown, comprises a chassis 12 and a body 14. The chassis 12 is composed of a relatively rigid plastic, such as copolymer polypropylene, whereas the body 14 is composed of a soft, elastomeric plastic, such as polyvinyl chloride.

Describing the construction of the chassis 12, it will be discerned that it includes what will be termed a box-like frame 16 having a front wall 18, a rear wall 20, side walls 22 and 24 and a bottom wall 26. The various walls 18–26 form an upwardly facing cavity or recess 28.

It is important to note that the front wall 18 has an integral forwardly directed horizontal flange 30, whereas the rear wall 20 has a similar flange 32 that extends rearwardly. Also, it is to be observed that the side wall 22 is provided with a laterally issuing flange 34, whereas the other side wall 24 has a laterally issuing flange 36.

Also, the chassis 12 is fabricated with oppositely issuing or directed front axles 38 and a similar pair of oppositely issuing rear axles 40. Each axle 38 and 40, as the case may be, includes a strip 42 that is molded integrally with the underside of the bottom wall 26, each strip 42 terminating in an outwardly located cylindrical shaft 44. It is on the various shafts 44 that wheels 46 are rotatably mounted. The wheels 46 are also of relatively hard plastic, such as the copolymer polypropylene mentioned as the material for the frame or box 16. In other words, the chassis 12 and its wheels 46 are all of a hard plastic.

In contrast to the hard material of which the chassis 12 and wheels 46 are composed is the material for the body 14. In this instance, the body 14 is of a relatively soft, elastomeric material, such as polyvinyl chloride. Although the body 14 can be molded in various shape so as to represent different forms of vehicle bodies, the body 14 in the illustrative case has been configured to simulate an automobile body. The body 14 is provided with a seat or cavity 52 into which the child can place various items. Also, the body has four fenders 54 molded integrally therewith.

Figure 3:
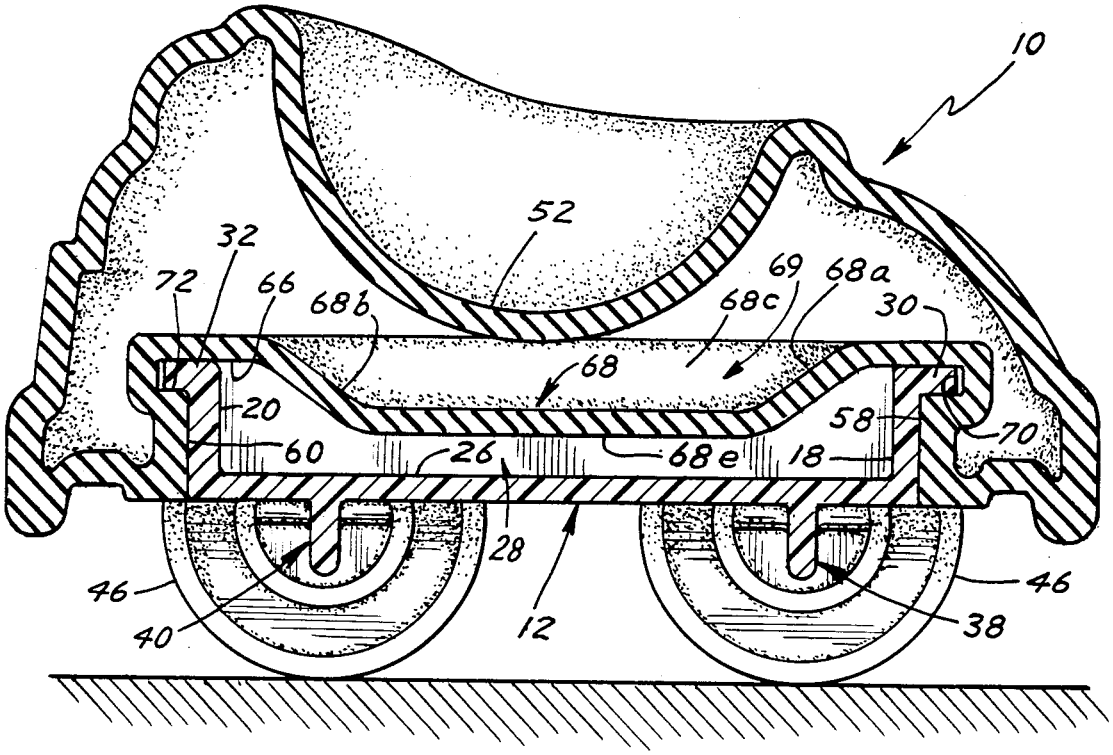
FIG. 3 is a longitudinal sectional view taken in the direction of line 3—3 of FIG. 1.
Figure 4:
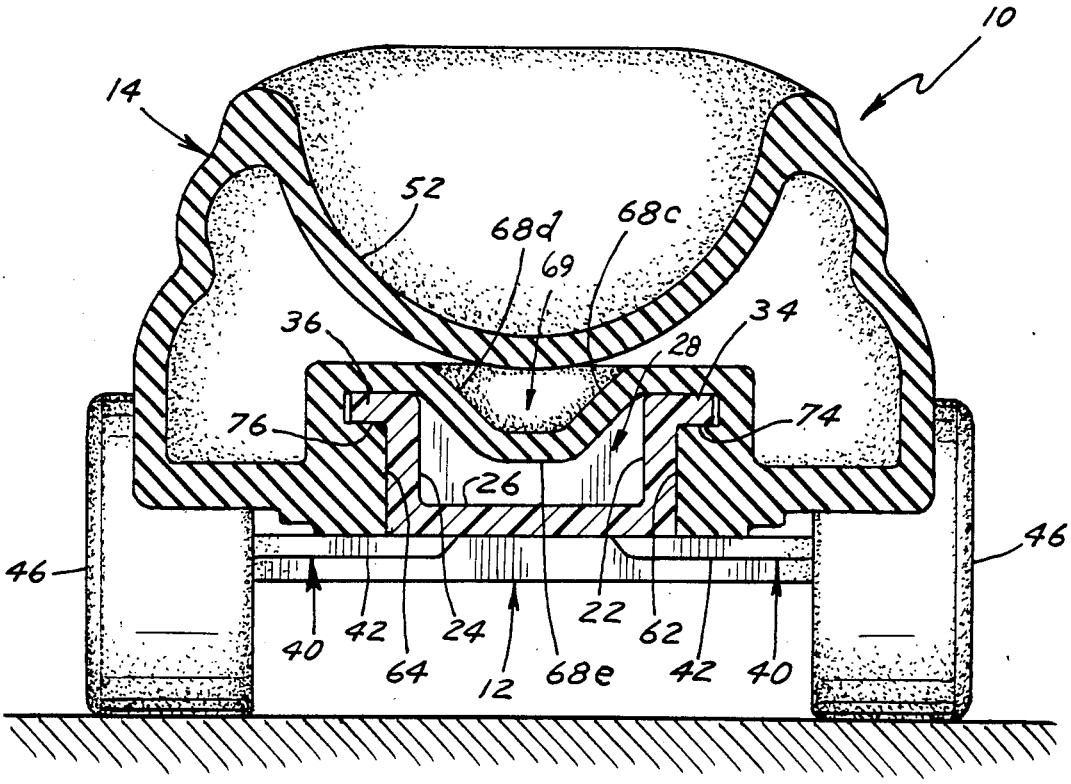
FIG. 4 is a transverse sectional view taken in the direction of line 4—4 of FIG. 1.

The body 14 is intended to be interfitted with the chassis 12. Therefore, there is provided a downwardly facing recess 56 having a front wall 58, a rear wall 60, side walls 62, 64 and a top wall 66. The top wall 66 has a truncated pyramidal portion 68 projecting downwardly therefrom. More specifically, the truncated pyramidal portion 68 includes a sloping front wall 68*a*, a sloping rear wall 68*b*, sloping side walls 68*c*, 68*d* and a flat bottom wall 68*e*. As clearly deducible from FIGS. 3 and 4, the truncated pyramidal portion 68 projects downwardly into the recess 28 formed in the chassis 12, forming an upwardly facing trough 69 into which the lower portion of the seat or cavity 52 depends without interference, as can be understood from FIGS. 3 and 4. The sloping walls 68*a*, 68*b*, 68*c* and 68*d* permit a more ready release of the molding die, it can be pointed out.

More importantly than the truncated pyramidal portion 68 is a feature now to be referred to. This feature involves the grooving of the walls 58–64. More specifically, the front wall 58 is formed with a forwardly extending groove 70 located adjacent the juncture thereof with the top wall 66, whereas the rear wall 60 has a similarly located rearwardly directed groove 72. By the same token, the side wall 62 is formed with a laterally directed groove 74 and the side wall 64 similarly divided with a laterally directed groove 76. The groove 70 receives therein the flange 30, the groove 72 and flange 32, the groove 74 the flange 34 and the groove 76 the flange 36. The use of the four flanges 30–36 and the engagement thereof in the grooves 70–76, respectively, assures retention of the body 14 on the chassis 12.

From the description that has been given, it should be apparent that the resilient or deformable property of the body 14, being composed of an elastomeric material, is sufficiently elastic so as to stretch forwardly, rearwardly and laterally in all four directions so that the various flanges 30–36 can be received in the grooves 70–76. When the stretched body 14, namely, the recess 56 formed by the walls 58–64, is permitted to contract, that is, return to its undeformed state, then the flanges 30–36 are firmly held within the grooves 70–76. The forcing of the flanges 30–36 into the grooves 70–76 results in the stretching of the elastomeric material constituting the body 14 so that when the stretched material is allowed to contract, the interfitting that results is a firm and positive fit that makes it difficult to separate the body 14 from the chassis 12. Stated somewhat differently, it is planned that the body 14 remain engaged with the chassis 12, this being so that the vehicle 10 constitutes a unitary structure when so assembled.

It will be recognized that to fabricate or manufacture a vehicle 10 of the shape depicted, the dies would have to be extremely complicated. By resorting to two parts, that is, the chassis 12 and the body 14, these two parts 12 and 14 can be individually molded with dies that can readily provide the interfitting that is required so as to constitute virtually a single structure when the chassis 12 and body 14 are assembled together. It will be appreciated that the assembly procedure is extremely simple, for all that is required is that the body 14 be pressed downwardly against the chassis 12. Sufficient force produces a snap action type of engagement, for, as described above, the elastomeric material constituting the body 14 stretches and permits the flanges 30–36 to pass upwardly, relatively speaking, so as to be received in the grooves 70–76.

The manner in which the wheels 46 are held on the axles 38 and 40, more specifically the shafts 44 thereof, is unimportant to a practicing of the present invention. All that need be understood is that the wheels 46 render the vehicle 10 mobile. Thus, the vehicle, when the chassis 12 and body 14 are fitted together, can be played with as a unit. The child has the opportunity to place whatever items he or she chooses in the cavity or recess 28. Also, the vehicle 10 can be manipulated by simply grasping the sides of the body 14, for the chassis 12 is for all intents and purposes fixedly or attached to the body by reason of the previously mentioned flange and groove construction. Thus, an extremely simple, yet low cost, toy vehicle 10 can be fabricated when following the teachings of our invention.

I claim:

1. A toy vehicle comprising a chassis of relatively hard material including a box-like frame having oppositely directed first and second flanges thereon, and a body of relatively soft, resilient material having walls forming a downwardly facing recess, said walls being formed with first and second oppositely directed grooves for receiving therein said flanges, said first groove having a width substantially corresponding to the thickness of said first flange and said second groove having a width substantially corresponding to the thickness of said second flange, whereby said body can be deformed sufficiently to permit said flanges to be introduced into said grooves and remain received therein via which said body is attached to said chassis.

2. A toy vehicle in accordance with claim 1 in which said recess accommodates at least the upper portion of said box frame therein.

3. A toy vehicle in accordance with claim 2 in which said flanges are located at the upper edge of the walls of said box-like frame and project substantially at right angles from said walls, and said grooves are located adjacent the upper portion of said recess.

4. A toy vehicle comprising a chassis having a relatively rigid box fabricated from a relatively hard plastic material including upstanding front, rear and side walls providing an upwardly facing recess, each of said walls having an outwardly directed flange thereon, and a body having a downwardly facing recess for receiving therein at least an upper portion of said box, said body having front, rear and side walls forming said recess, said front, rear and side walls of said body each having a groove formed therein for receiving said flanges so as to retain said body in an attached relation with said chassis, said body being fabricated from a relatively soft elastomeric material so that said body can be stretched sufficiently and so that said box can be inserted into the downwardly facing recess of said body to the extent that said flanges are received in said grooves.

5. A toy vehicle comprising a chassis having a relatively rigid box providing an upwardly facing recess, said box including upstanding front, rear and side walls, each wall having an outwardly directed flange thereon, and a body having a downwardly facing recess for receiving therein at least an upper portion of said box, said body having front, rear and side walls forming said recess, said front, rear and side walls of said body each having a groove formed therein for receiving said flanges so as to retain said body in an attached relation with said chassis, said chassis being fabricated from a relatively hard plastic material and said body being fabricated from a relatively soft elastomeric material so that said body can be stretched sufficiently and so that said box can be inserted into the downwardly facing recess of said body to the extent that said flanges are received in said grooves, said downwardly facing recess of said body having a top wall, said top wall having a downwardly projecting truncated pyramidal portion that extends into said upwardly facing recess of said chassis.

6. A toy vehicle in accordance with claim 5 in which said truncated pyramidal portion has sloping walls, at least two of said walls engaging the upper edges of two of the walls of said upwardly facing recess.

* * * * *

UNITED STATES PATENT AND TRADEMARK OFFICE

CERTIFICATE OF CORRECTION

PATENT NO. : 4,678,451

DATED : July 7, 1987

INVENTOR(S) : Frank D. Ventura

It is certified that error appears in the above-identified patent and that said Letters Patent are hereby corrected as shown below:

On the title page

In the References Cited portion, Patent No. "4,451,109" should be -- 4,551,109 --;

Col. 2, line 18; "EMBODIMENTS" should be -- EMBODIMENT --.

Signed and Sealed this

Twenty-fourth Day of November, 1987

*Attest:*

DONALD J. QUIGG

*Attesting Officer*

*Commissioner of Patents and Trademarks*